United States Patent [19]

Gill et al.

[11] 4,258,853

[45] Mar. 31, 1981

[54] EXTENSIBLE BOOM FOR CRANES

[75] Inventors: Stephen H. Gill, Mentor, Ohio; Theodore B. Hogg, Aurora, Ill.

[73] Assignee: Caterpillar Tractor Co., Peoria, Ill.

[21] Appl. No.: 899,433

[22] Filed: Apr. 24, 1978

[51] Int. Cl.[3] ..... B66C 23/06; B66C 23/62

[52] U.S. Cl. ..... 212/264; 212/231; 212/265; 212/268; 52/118; 52/115

[58] Field of Search ..... 212/55, 46 B, 57, 144, 212/231, 264, 265, 268; 92/117, 137, 126, 165 R; 52/115, 118, 121

[56] References Cited

U.S. PATENT DOCUMENTS

| | | | |
|---|---|---|---|
| 3,462,023 | 8/1969 | Grove | 212/144 X |
| 3,752,327 | 8/1973 | Olson | 212/55 |
| 4,098,172 | 7/1978 | Wright et al. | 212/55 X |
| 4,132,040 | 1/1979 | Grove | 212/55 X |
| 4,133,411 | 1/1979 | Curb | 52/118 X |

*Primary Examiner*—Stephen G. Kunin
*Assistant Examiner*—R. B. Johnson
*Attorney, Agent, or Firm*—Phillips, Moore, Weissenberger, Lempio & Majestic

[57] ABSTRACT

A telescopic boom is pivotally mounted on a frame of a vehicle and comprises telescopically disposed first, second, third and fourth sections. A double-acting cylinder has a rod thereof connected to the first section and a housing thereof connected to the second section. A first pulley is rotatably mounted on a forward end of the cylinder housing and a second pulley, having a larger diameter than the first pulley, is rotatably mounted on a rearward end of the cylinder housing. A first end of a cable is secured to the first section and is sequentially entrained over the first pulley, secured to the third section, entrained over the second pulley and has a second end thereof secured to a forward end of the first section. Thus, extension of the cylinder will function to extend the second section relative to the first section and simultaneously extend the third section at twice the linear speed as that of the second section. The fourth section of the boom is adapted to have a rearward end thereof connected to a forward end of the third section to substantially increase the overall working length thereof.

18 Claims, 7 Drawing Figures

EXTENSIBLE BOOM FOR CRANES

BACKGROUND OF THE INVENTION

A telescopic boom is oftentimes employed on cranes and other types of construction vehicles to dispose a work tool, mounted forwardly on the boom, at extended positions around the crane. The boom is comprised of telescopic sections which are extended and retracted relative to each other by one or more hydraulic cylinders. When the boom comprises three or more such sections, it has proven difficult to integrate the cylinders into the boom to permit relative and precisely controlled extension of the sections.

SUMMARY OF THE INVENTION

The present invention is directed to overcoming one or more of the problems as set forth above.

The extensible boom of this invention comprises at least three telescopically disposed section and an extensible and retractable first actuating means connected to a first one of the sections. A second actuating means is interconnected between the three sections and the first actuating means for extending the second and third sections relative to the first section and for extending the third section relative to the second section in response to selective extension of the first actuating means.

In carrying forth the method of this invention, the boom may be further lengthened by extending a fourth section relative to the third section. Upon extension of the third section relative to the second section, the fourth section will remain extended beyond the third section to substantially increase the overall length and reach of the boom.

BRIEF DESCRIPTION OF THE DRAWINGS

Other objects of this invention will become apparent from the following description and accompanying drawings wherein:

FIG. 6 is a partial view of the sectioned boom, similar to FIG. 2, but showing the boom in an extended condition of operation.

DETAILED DESCRIPTION

Figure 1:
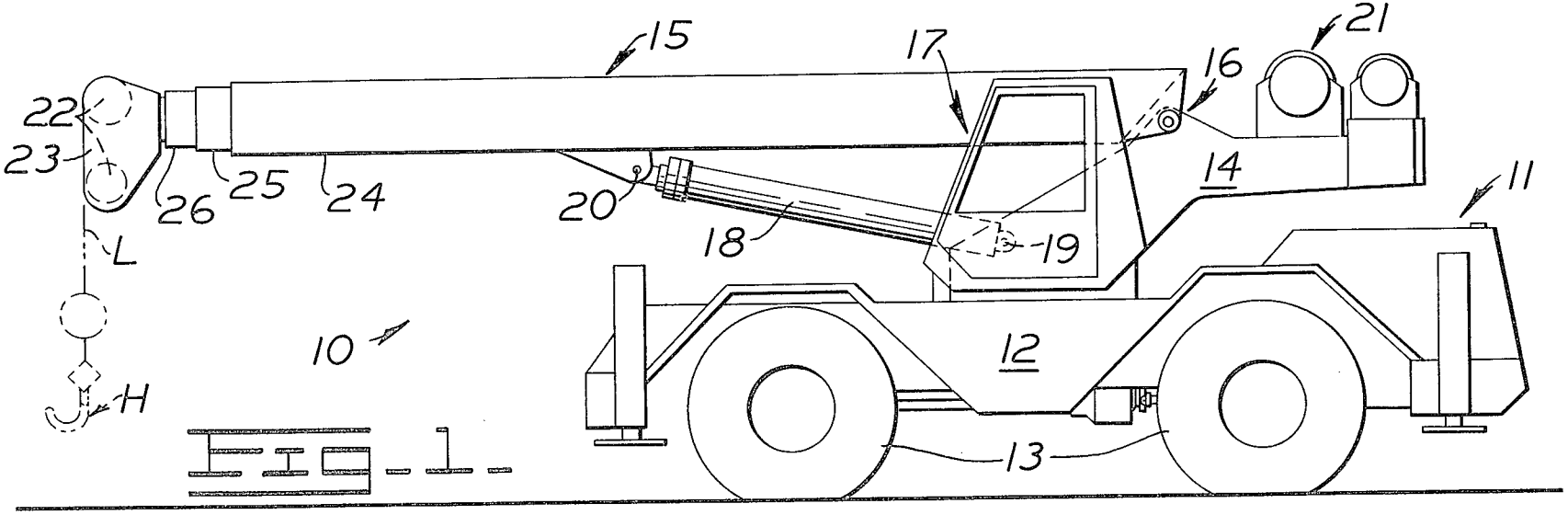
FIG. 1 is a side elevational view of a crane comprising a boom of this invention pivotally mounted thereon.

FIG. 1 illustrates a mobile crane 10 comprising a mobile vehicle 11, such as a wheel-type tractor or truck frame, having a lower frame or undercarriage 12 mounted on four roadwheels (two shown). Alternatively, the crane could be mounted on a pair of laterally spaced track assemblies of conventional design. An upper frame or turntable 14 is mounted in a conventional manner on the lower frame for rotational movements thereon. A rearward end of a boom 15 is pivotally mounted at 16 on the upper frame, rearwardly of an operator's station 17 which is suitably mounted on the upper frame in offset relationship to the boom.

Actuating means for selectively raising and lowering the boom relative to ground level may comprise a single double-acting hydraulic cylinder 18 pivotally interconnected between frame 14 and boom 15 by pivot pins 19 and 20, respectively. The cylinder is disposed directly under the boom and the boom and cylinder are disposed in offset relationship, on one lateral side of the operator's station, to afford the operator with substantially unobstructed visibility forwardly of the vehicle. A winch means 21 is mounted on frame 14, rearwardly of boom 15 and operator's station 16, to pay-out and pay-in a line L, entrained over a sheave 22 rotatably mounted on a forward end of the boom.

The free end of the line may have a hook H or other work tool, such as a bucket, attached thereto for work performing purposes. As will be hereinafter described, the boom is telescopic whereby selective extension and retraction of sections thereof may be effected under control of the operator. Sheaves 22 are rotatably mounted on a bracket 23, secured to a forward end of the boom to form an integral part thereof.

Figures 2, 5:
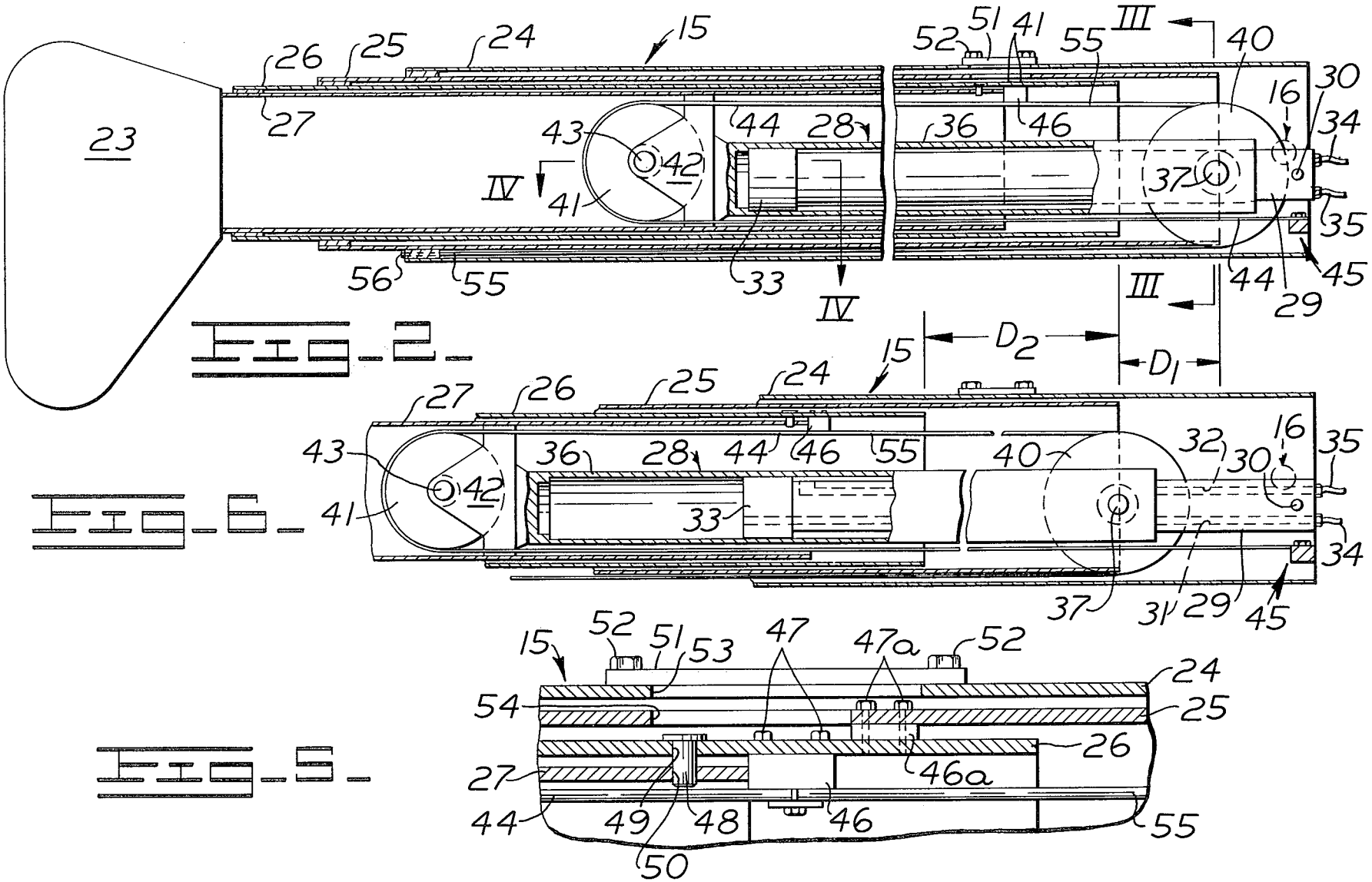
FIG. 2 is an enlarged longitudinal sectional view of the boom, shown in its retracted condition of operation.
FIG. 5 is an enlarged sectional view of a portion of the boom, more clearly illustrating attachment means for sections employed therein.

FIGS. 2–6 illustrate the details of boom 15. The boom comprises first, second, third and fourth telescopically disposed sections 24–27, respectively. As shown in FIGS. 1 and 2, the rearward end of first or outer section 24 is pivotally mounted on upper frame 14 by pivot means 16 and has cylinder 18 pivotally connected thereto. An extensible and retractable first actuating means in the form of a double-acting hydraulic cylinder 28 has a piston rod 29 thereof pivotally attached at its rearward end to first section 24 by a pivot pin 30.

A pair of passages 31 and 32 are formed through the rod to alternatively pressurize or exhaust hydraulic fluid from either side of a piston or head end 33 of rod 29. Passages 31 and 32 are connected to flexible lines 34 and 35, respectively. The lines are adapted for connection to a conventional control valve (not shown) for selectively and alternately communicating pressurized hydraulic fluid to one passage and to exhaust the other passage in a conventional manner.

Figure 3:
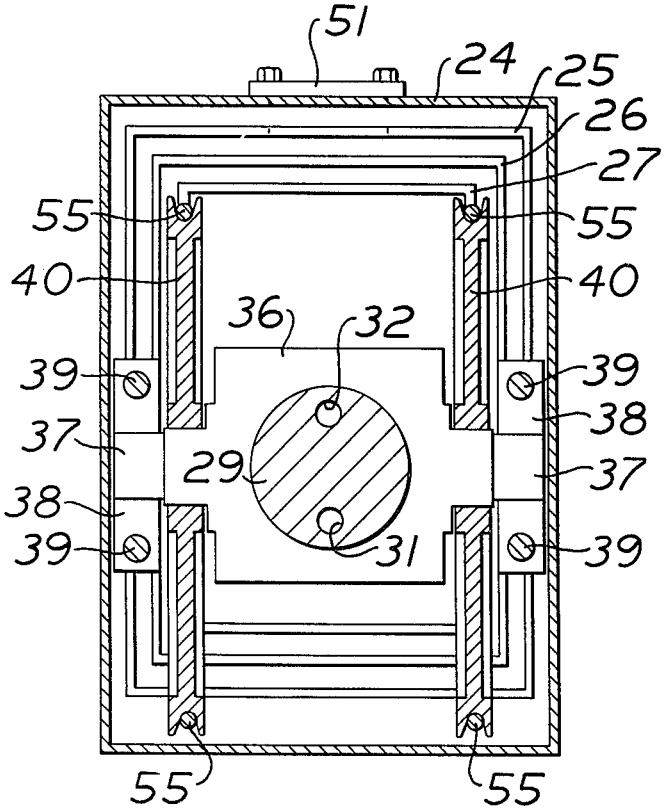
FIG. 3 is an enlarged sectional view of the boom, taken in the direction of arrows III—III in FIG. 2.

Cylinder 28 further comprises a tubular housing 36 having its rearward end trunnion-mounted to second section 2 of boom 15, as more clearly shown in FIG. 3. The mounting comprises a pair of stub shafts 37 secured to housing 36 and each pivotally mounted on a sidewall of section 25 by a pair of pillow blocks 38 (one shown), releasably attached together by a pair of bolts 39. A pulley 40 is rotatably mounted on each stub shaft 37 for purposes hereinafter explained.

Figure 4:
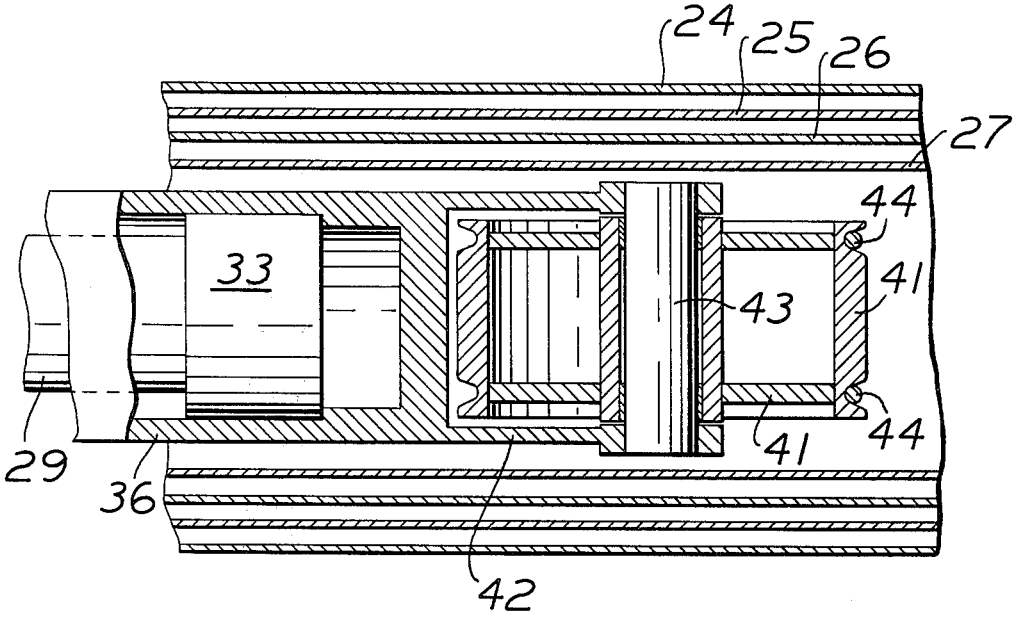
FIG. 4 is an enlarged sectional view of the boom, taken in the direction of arrows IV—IV in FIG. 2.

As shown in FIGS. 2 and 4, a pulley 41 is rotatably mounted on a bifurcated bracket 42, secured to a forward end of cylinder housing 36, by an axle 43. A plurality of first cables 44, the number of which will depend on the magnitude of load carried, each has a first end thereof secured at 45 to first section 24 of the boom. Each cable is entrained over pulley 41 and has a second end thereof secured to a block 46 which is further releasably attached to an interior wall of third boom section 26 by a pair of cap screws or fastening means 47.

As more clearly shown in FIG. 5, a releasable pin or attachment means 48 is normally disposed in a pair of aligned apertures 49 and 50 formed through third and fourth boom sections 26 and 27, respectively, prior to extension of the fourth section relative to the third section. A cover plate 51 is releasably attached to an outer surface of first and outer boom section 24 by a plurality of cap screws 52. The plate normally covers a pair of apertures 53 and 54, formed through the first and second sections of the boom, which are aligned radially to overlie cap screws 47 and pin 48 when the boom is maintained in its retracted condition of operation, illustrated in FIGS. 2 and 5.

Referring once again to FIG. 2, a pair of second cables 55 each has a first end thereof secured to the interior of first boom section 24, as shown at 56. Each cable is entrained over a respective pulley 40, having a larger diameter than that of pulley 41, and has its second end anchored to block 46. Alternatively, each plurality of cables 55 could constitute a single, continuous cable. As will be hereinafter described, pulleys 40 and 41 and the four cables 44 and 55 comprise second actuating means interconnected between sections 24, 25 and 26 of the boom and cylinder 28 for extending sections 25 and 26 relative to section 24 and for further extending section 27 relative to section 26 in response to selective extension of the cylinder.

In operation and referring to FIG. 6, such extension of the boom sections is effected by pressurizing the head end of cylinder 28 via line 34 and passage 31 and simultaneously exhausting the rod end of the cylinder via line 35 and passage 32. Extension of cylinder housing 36 relative to rod 29 will place cables 44 in tension to extend third boom section 26 relative to second boom section 25. Simultaneously therewith, the cylinder housing, secured to blocks 38, will extend second boom section 25 relative to first boom section 24. The third boom section 26 will extend at twice the linear speed as second boom section 25, both relative to first boom section 24, as indicated by distances $D_1$ and $D_2$ in FIG. 2. Thus, at the end of one unit of cylinder stroke, the third section will move one unit relative to the second section (and two units relative to the first section) whereas the second section will move one unit relative to the first section.

Upon retraction of the cylinder, pressurized hydraulic fluid is communicated to the rod end of cylinder 28 via line 35 and passage 32 and the head end thereof is simultaneously exhausted via passage 31 and line 34. It should be understood that the rearward end of housing 36 is closed and a suitable sliding seal (not shown) is provided between the housing and rod 29 to prevent the egress of hydraulic fluid thereby. Upon retraction of the cylinder, stub shafts 37, secured to cylinder housing 36, will move second boom section 25 rightwardly in FIG. 6. Simultaneously therewith, cable 55 will be placed in tension to also move block 46 and thus third boom section 26 rightwardly at a linear speed twice that of second boom section 25, both relative to first boom section 24. In both the above described extension and retraction modes of operation of the boom, pin 48 (FIGS. 2 and 5) is assumed to have been retained in its illustrated position, attaching third and fourth boom sections 26 and 27 together for simultaneous movement.

Should it be desired to extend fourth boom section 27 relative to third boom section 26, the following method of operation is followed. Cover plate 51 is removed from boom section 24 by releasing cap screws 52 when the boom is retracted, as shown in FIG. 2. As more clearly shown in FIG. 5, removal of cover plate 51 exposes cap screws 47 and pin 48 for removal thereof via access apertures 53 and 54, formed through first and second boom sections 24 and 25, respectively. A block **46*a* placed between sections 25 and 26 and bolts 47*a* are utilized to secure the sections together. The boom is then extended, as described above, in response to extension of cylinder 28**.

Figure 7:
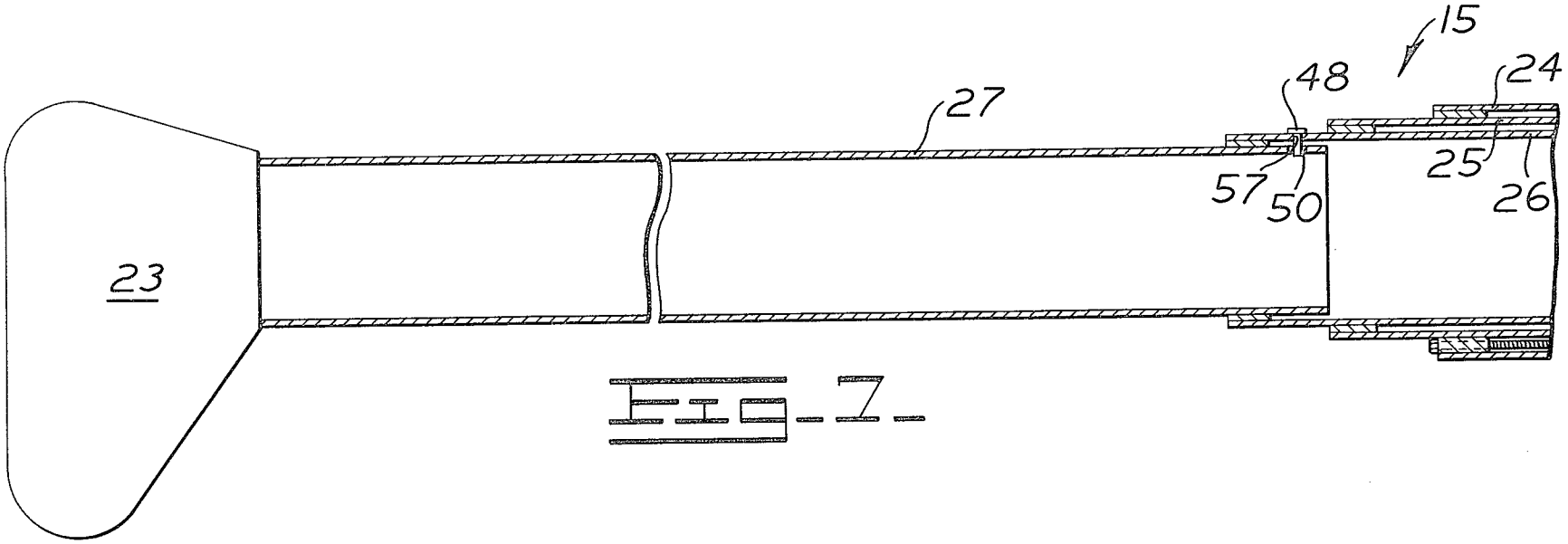
FIG. 7 is a partial view of a forward end of the boom, illustrating attachment of an extended section of the boom to another section thereof.

However, block 46 will now engage a rearward end of fourth boom section 27 to extend it relative to boom sections 25 and 26. Second and third boom sections 25 and 26 will move simultaneously since the rearward end of the second section (FIG. 3) is secured to pillow blocks 38. When the fourth boom section has been extended to its FIG. 7 position relative to the third boom section, pin 48 is mounted in aligned apertures 57 and 50, formed in the third and fourth boom sections, respectively.

Cylinder 28 is then retracted to reposition the boom sections, as shown in FIG. 2, but with fourth boom section 27 extended. Block **46*a* and bolts 47*a* are then removed and cap screws 47 and cover plate 51 may be replaced to permit full extension of the boom as described above. It should be noted that boom sections 25 and 26 will retract simultaneously since block 46*a* and bolts 47*a* secure the two sections together, as described above. When it is desired to retract fourth boom section 27 to its FIG. 2 position, pin 48 is released from apertures 50 and 57 (FIG. 7) and winch 21 is actuated to reel-in line L after hook 3** has been hooked to the front of the vehicle in an appropriate manner.

The embodiments of the invention in which an exclusive property or privilege is claimed are defined as follows:

1. An extensible boom comprising at least first, second, and third telescopically disposed sections, extensible and retractable first actuating means connected to said first section, and second actuating means interconnected between said first, second, and third sections and said first actuating means for extending said second and third sections relative to said first section and to further extend said third section relative to said second section in response to selective extension of said first actuating means, said second actuating means including at least one pair of longitudinally spaced first and second pulleys rotatably mounted on said first actuating means and cable means entrained about said pulleys and having opposite ends thereof secured to said first section and to said third section, fastening means for releasably securing said cable means to said third section, means defining aligned apertures through said first and second sections, overlying said fastening means, and a cover plate releasably attached exteriorly on said first section normally covering said apertures whereby said fastening means may be exposed upon removal of said cover.

2. The extensible boom of claim 1 wherein said first actuating means comprises a double-acting cylinder.

3. The extensible boom of claim 2 wherein said cylinder comprises a housing mounted on said second section and a piston rod reciprocally mounted in said housing.

4. The extensible boom of claim 3 wherein said piston rod has a pair of passages formed therein, communicating within said housing on either side of a head end of said piston rod, for selectively communicating pressurized fluid therethrough.

5. The extensible boom of claim 1 wherein said second actuating means comprises means for extending said third section at a greater linear speed than the linear speed of said second section, both relative to said first section.

6. The extensible boom of claim 1 wherein said first actuating means comprises a double-acting cylinder having a piston rod reciprocally mounted in a housing thereof and wherein said first pulley is rotatably mounted on a forward end of said housing and said second pulley is rotatably mounted on a rearward end of said housing, the rearward end of said housing mounted on a rearward end of said second section.

7. The extensible boom of claim 1 wherein said second pulley has a larger diameter than said first pulley.

8. The extensible boom of claim 1 further comprising a fourth section telescopically disposed within said third section and attachment means releasably attaching said third section to said fourth section, said attachment means underlying the apertures formed through said first and second sections and said cover plate whereby said attachment means may be released from said third and fourth sections upon removal of said cover plate.

9. The extensible boom of claim 1 further comprising a fourth section telescopically disposed within said third section and releasable attachment means normally attaching said third and fourth sections together.

10. A construction vehicle comprising a frame, a telescopic boom having a rearward end thereof pivotally mounted on said frame, and means interconected between said frame and said boom for selectively raising and lowering said boom, said boom comprising at least first, second, and third telescopically disposed sections, extensible and retractable first actuating means connected to said first section, second actuating means interconnected between said first, second, and third sections and said first actuating means for extending said second and third sections relative to said first section and said third section relative to said second section in response to selective extension of said first actuating means, said second actuating means including at least one pair of longitudinally spaced first and second pulleys rotatably mounted on said first actuating means and cable means entrained about said pulleys and having opposite ends thereof secured to said first section and further secured to said third section, fastening means releasably securing said cable means to said third section, means defining aligned apertures through said first and second sections, overlying said fastening means, and a cover plate releasably attached exteriorly on said first section normally covering said apertures whereby said fastening means may be exposed upon removal of said cover.

11. The construction vehicle of claim 10 wherein said first actuating means comprises a double-acting cylinder.

12. The construction vehicle of claim 11 wherein said cylinder comprises a housing mounted on said second section and a piston rod reciprocally mounted in said housing.

13. The construction vehicle of claim 12 wherein said piston rod has a pair of passages formed therein, communicating within said housing on either side of a head end of said piston rod, for selectively communicating pressurized fluid therethrough.

14. The construction vehicle of claim 10 wherein said second actuating means comprises means for extending said third section at a greater linear speed than the linear speed of said second section, both relative to said first section.

15. The construction vehicle of claim 10 wherein said first actuating means comprises a double-acting cylinder having a piston rod reciprocally mounted in a housing thereof and wherein said first pulley is rotatably mounted on a forward end of said housing and said second pulley is rotatably mounted on a rearward end of said housing, the rearward end of said housing mounted on a rearward end of said second section.

16. The construction vehicle of claim 10 wherein said second pulley has a larger diameter than said first pulley.

17. The construction vehicle of claim 10 further comprising a fourth section telescopically disposed within said third section and attachment means releasably attaching said third section to said fourth section, said attachment means underlying the apertures formed through said first and second sections and said cover plate whereby said attachment means may be released from said third and fourth sections upon removal of said cover plate.

18. The construction vehicle of claim 10 further comprising a fourth section telescopically disposed within said third section and releasable attachment means normally attaching said third and fourth sections together.

* * * * *